United States Patent [19]

Ito et al.

[11] Patent Number: 4,719,331

[45] Date of Patent: Jan. 12, 1988

[54] CERAMIC GLOW PLUG HAVING A TUNGSTEN-RHENIUM ALLOY HEATING WIRE

[75] Inventors: Masatoshi Ito; Katsuhiko Tanaka, both of Aichi, Japan

[73] Assignee: NGK Spark Plug Co., Ltd., Japan

[21] Appl. No.: 910,261

[22] Filed: Sep. 19, 1986

Related U.S. Application Data

[63] Continuation of Ser. No. 624,071, Jun. 25, 1984, abandoned.

[30] Foreign Application Priority Data

Jul. 29, 1983 [JP] Japan ..... 58-137489

[51] Int. Cl.[4] ..... H05B 3/00; F02P 19/00; F02B 9/08

[52] U.S. Cl. ..... 219/270; 123/145 A; 219/523; 219/544; 219/552; 219/553; 361/264; 420/432

[58] Field of Search ..... 219/260–270, 219/523, 544, 552, 553; 123/145 R, 145 A; 338/330; 361/264–266; 420/432

[56] References Cited

U.S. PATENT DOCUMENTS

| | | | |
|---|---|---|---|
| 1,418,081 | 5/1922 | Louise | 420/432 |
| 2,030,937 | 2/1936 | Reichmann | 219/270 X |
| 2,157,936 | 5/1939 | Hensel et al. | 420/432 |
| 2,202,108 | 5/1940 | Louise | 420/432 |
| 3,236,699 | 2/1966 | Pugh et al. | 420/432 X |
| 3,479,161 | 11/1969 | Evans | 29/195 |
| 3,573,903 | 4/1971 | Delgrosso | 75/176 |
| 3,637,374 | 1/1972 | Holgi et al. | 75/174 |
| 3,875,444 | 4/1975 | Magendans et al. | 313/330 |
| 4,345,555 | 8/1982 | Oshima et al. | 123/145 A X |
| 4,357,526 | 11/1982 | Yamamoto et al. | 219/544 |
| 4,359,977 | 11/1982 | Sperner et al. | 123/145 A |
| 4,401,065 | 8/1983 | Minegishi et al. | 123/145 A |
| 4,499,334 | 12/1985 | Merritt et al. | 219/523 X |
| 4,502,430 | 3/1985 | Yokoi et al. | 123/145 A |
| 4,636,614 | 1/1987 | Itoh et al. | 219/270 |

FOREIGN PATENT DOCUMENTS

| | | | |
|---|---|---|---|
| 2433521 | 3/1980 | France | 219/270 |

*Primary Examiner*—Anthony Bartis
*Attorney, Agent, or Firm*—Sughrue, Mion, Zinn Macpeak, and Seas

[57] ABSTRACT

A ceramic glow plug in which a large resistance suitable for adapting the plug for use with a 24 V battery without having to use a thin or long heating wire. The glow plug includes a ceramic heater having a sintered ceramic body and a heating wire made of an alloy of a high melting point metal such as tungsten embedded in the ceramic body. The ceramic heater is secured to one end of a metal sheath with an outer end portion of the ceramic heater protruding from the end of the metal sheath by as small a distance as possible. A mounting shell receives the other end of the metal sheath. The heating wire is preferably made of a tungsten alloy containing 5 to 39 wt % rhenium to provide the desired resistance.

1 Claim, 4 Drawing Figures

CERAMIC GLOW PLUG HAVING A TUNGSTEN-RHENIUM ALLOY HEATING WIRE

This is a continuation of Ser. No. 624,071 filed on June 25, 1984, now abandoned.

BACKGROUND OF THE INVENTION

The present invention relates to a ceramic glow plug for starting a diesel engine, and more particularly to a ceramic heater of such a glow plug.

It is well known generally that a diesel engine is hard to start at low temperatures. In order to resolve this problem, it has been the practice to provide a glow plug in the engine's cylinders or in auxiliary combustion chambers thereof for increasing the temperature of the cylinders or the auxiliary combustion chambers. In order to provide quick starting, a glow plug has to have a rapid heating characteristic. Further, due to the recent tendency to use glow plugs not only for starting but also during the engine operation to stabilize the fuel combustion in the cylinder after the engine has started, improvements in the electrical and chemical durabilities of glow plugs have been demanded.

In order to meet this demand, a ceramic glow plug of a rapid-heating type has been developed which includes a ceramic heater composed of a sintered ceramic body and a tungsten heating wire embedded therein. Tungsten is used because it has a high melting point and is heat durable.

FIG. 1 shows, in partial cross section, an example of such a conventional ceramic glow plug. In FIG. 1, a ceramic glow plug 1 includes a ceramic heater 3 constituted by a sintered ceramic body of $Si_3N_4$ and a heating wire 2 in the form of a coil embedded therein. The ceramic heater 3 is fixedly secured to one end of a metal sheath 4 to which one end of the heating wire 2 is connected. The metal sheath 4, which is connected to a mounting shell 5, functions as a negative electrode. The other end of the heating wire 2 is connected to a center conductor 6 supported in the shell 5 and electrically insulated therefrom. The center conductor 6 functions as a negative electrode.

A portion 3' of the ceramic heater 3 of the ceramic glow plug 1 in which the heating coil 2 is embedded protrudes from the end of the metal sheath 4 by a distance l. The distance l is typically 12 to 15 mm for a glow plug operated by a 12 V battery. This distance should be as short as possible for reasons of mechanical strength against mechanical shock applied to the ceramic glow plug. In the conventional ceramic glow plug, however, it is impossible to shorten the distance l because, if the ceramic heater 3 is merely pushed into the metal sheath 4 as shown in FIG. 2 to reduce the distance l of the exposed portion 3' thereof to $l_1$, the portion of the heating wire of the ceramic heater 3 corresponding to a distance $l_2$ is covered by the metal sheath 4, resulting in a reduced heating efficiency of the heating coil. In addition, the heating wire in the metal sheath may overheat, causing a soldering material used to connect the ceramic heater 3 to the metal sheath 4 to be melted.

For a ceramic glow plug used with a 24 V battery, in order to obtain the same temperaure of the ceramic heater as that of the 12 V ceramic heater, the resistance of the heating coil must be about four times that of the heating coil for the 12 V battery. If such a large resistance is obtained by reducing the diameter of the heating wire, which is usually about 0.2 mm for the 12 V battery, the diameter must be about 0.1 to 0.13 mm for the 24 V battery. When such a thin heating wire is embedded in a ceramic body, it cannot withstand the unavoidable torsional stresses applied thereto due to the difference in thermal expansion coefficients between the ceramic and the heating wire. On the other hand, if the increase of the resistance is obtained by using a longer wire, the distance l of the ceramic heater portion protruding from the end of the metal sheath is necessarily increased. Thus, these approaches are not usable in view of the mechanical strength of the ceramic glow plug.

SUMMARY OF THE INVENTION

The present invention was made in view of the above mentioned state of art, and an object of the present invention is to provide a ceramic glow plug having a ceramic heater the mechanical strength of which is remarkably improved.

According to the present invention, the above object is achieved by employing, as a heating wire material of the ceramic heater, a tungsten alloy containing at least one element selected from the group consisting of cobalt, rhenium, thorium, zirconium and thorium oxide. Such a tungsten alloy has a specific resistance larger than that of pure tungsten, which is used conventionally. Preferably, the tungsten alloy contains 5 to 30 wt% rhenium.

By employing heating wire of such a tungsten alloy, the heating coil can be made smaller compared with the conventional coil, and thus the length l of the ceramic heater which protrudes from the metal sheath can be shortened, resulting in an improvement of the mechanical strength of the ceramic glow plug.

DESCRIPTION OF THE PREFERRED EMBODIMENTS

Figure 1:
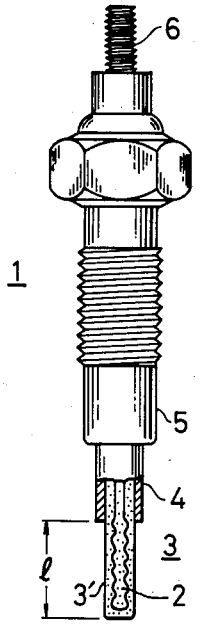
FIG. 1 PRIOR ART
FIG. 1 is a partial cross section of an example of a conventional ceramic glow plug.
Figure 3:
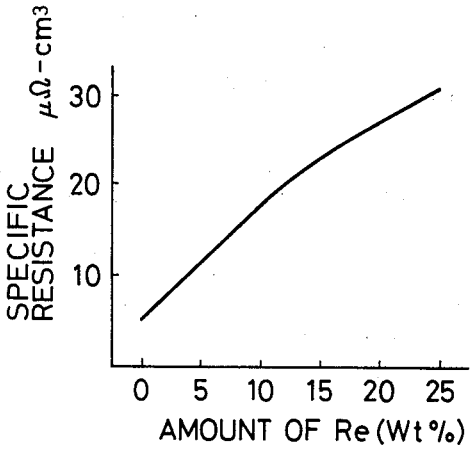
FIG. 3 is a graph showing a relation between an amount of rhenium contained in a tungsten alloy and a specific resistance thereof.
Figure 2:
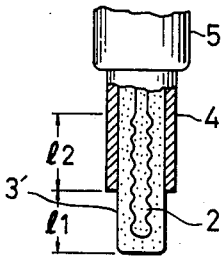
FIG. 2 PRIOR ART
FIG. 2 illustrates a similar ceramic glow plug to that shown in FIG. 1, the ceramic heater of which is modified according to one of the conventional considerations to improve the mechanical strength thereof.

FIG. 3 is a graph showing the relation between the amount of rhenium contained in a tungsten alloy and the specific resistance of the alloy, with the amount of rhenium being varied from 5 wt% to 30 wt%.

When a heating coil prepared by using a tungsten alloy containing 15 wt% rhenium is used in a 12 V ceramic heater, the effective length of the tungsten alloy wire is about half that of the conventional wire of pure tungsten, and therefore the length of the ceramic heater which protrudes from the metal sheath is about half that of the conventional heater.

Figure 4:
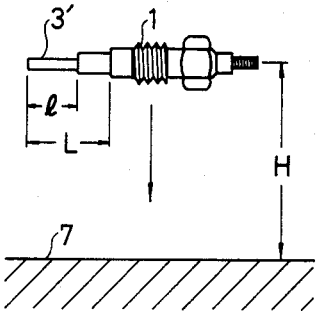
FIG. 4 illustrates a test method used to evaluate the mechanical strength of the ceramic glow plug.

The following table shows the results of tests conducted on three conventional ceramic glow plugs, the length l of the protrusion 3' of which is 15 mm, and three ceramic glow plugs according to the present invention for comparing the durability thereof against mechanical shocks. The tests were performed by dropping each ceramic glow plug 1 held horizontally onto a floor 7 as shown in FIG. 4 and measuring the height H at which the exposed portion 3' of the ceramic heat 1 was broken.

TABLE

| | Sample No. | L (mm) | l (mm) | H (m) |
|---|---|---|---|---|
| Conventional glow plug | 1 | 25 | 15 | 1.3 |
| | 2 | 25 | 15 | 1.1 |
| | 3 | 25 | 15 | 1.5 |
| Invention | 1 | 25 | 8 | 4.2 |
| | 2 | 25 | 8 | 3.8 |
| | 3 | 25 | 8 | 4.5 |

As can be seen from the Table, the height in the case of the ceramic glow plug according to the present invention is about three times that in the case of the conventional glow plug, showing superior anti-shock strength.

In another embodiment of a ceramic glow plug designed for a 24 V battery system, the heating wire is made of a tungsten alloy containing 25 wt% rhenium. In this case, the effective length of the heating wire in the shape of coil can be made substantially equal to that of the 12 V embodiment described previously.

The ceramic glow plugs according to the present invention were subjected to a heat cycle test where it was found that their ceramic heaters showed a superior durability.

As described hereinbefore, according to the present invention, the ceramic heater of a ceramic glow plug can be minimized in size by employing a tungsten alloy having the described composition and having a specific resistance larger than that of pure tungsten wire, which has been used in the conventional ceramic heater. Thus, the size of the exposed portion of the ceramic heater can be minimized, resulting in a superior anti-shock performance. Furthermore, the specific resistance of the tungsten alloy heating wire can be arbitrarily selected by appropriately selecting the materials contained in the alloy. Therefore, there is no need of making the diameter thereof small or increasing the length thereof to increase the resistance of the wire.

We claim:

1. A ceramic glow plug comprising: a ceramic heater including a sintered ceramic body and a heating wire of a high melting point metal embedded in said ceramic body, a metal sheath, said ceramic heater being secured to one end of said metal sheath with an outer end portion of said ceramic heater protruding from said one end of said metal sheath, and a mounting shell, said mounting shell receiving the other end of said metal sheath, said heating wire being made of a tungsten alloy containing rhenium, in an amount selected to provide a desired resistance of said wire, wherein said tungsten alloy contains 5 to 30 wt% rhenium.

* * * * *